United States Patent [19]

Simpson

[11] 4,337,504

[45] Jun. 29, 1982

[54] ELECTRONIC EARRING

[76] Inventor: Colin V. M. Simpson, 175 Trudelle St., Unit 8, Scarborough, Ontario, Canada, M1J 3K5

[21] Appl. No.: 180,958

[22] Filed: Aug. 25, 1980

[51] Int. Cl.[3] ..... F21L 15/18

[52] U.S. Cl. ..... 362/104; 362/800

[58] Field of Search ..... 362/104, 800

[56] References Cited

U.S. PATENT DOCUMENTS

| | | | |
|---|---|---|---|
| 3,383,503 | 5/1968 | Montgomery | 362/104 |
| 3,384,740 | 5/1968 | Wood | 362/104 |
| 3,508,041 | 4/1970 | Sweany et al. | 362/104 |
| 3,689,758 | 9/1972 | Power | 362/104 |
| 3,814,926 | 6/1974 | Frasca | 362/104 |
| 3,818,209 | 6/1974 | Roth | 362/104 |
| 3,866,035 | 2/1975 | Richey, Jr. | 362/104 |
| 4,220,983 | 9/1980 | Schroeder | 362/800 |

*Primary Examiner*—Peter A. Nelson

[57] ABSTRACT

The present invention provides an electrical earring for use on a pierced ear. The arrangement comprises a portable, electrical power source connected to a load by a pair of electrical connectors. The arrangement is such that one of the electrical connectors is adapted to project through the earlobe to both close the electrical circuit and, in co-operation with the power source, provide a clip to secure the earring in place on the ear.

12 Claims, 5 Drawing Figures

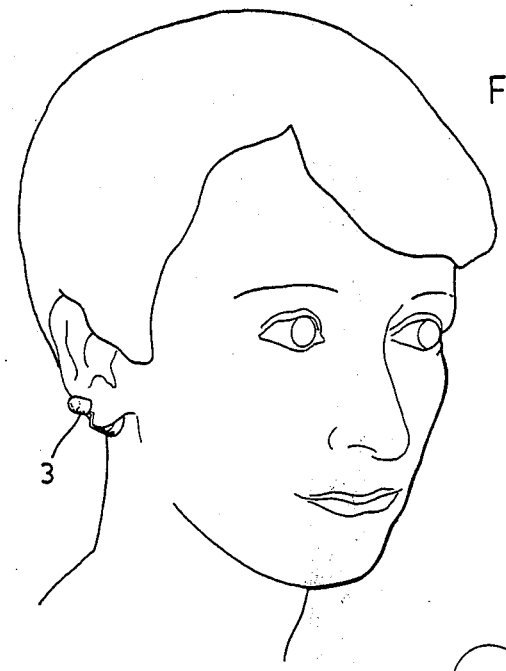
FIG. 4.
FIG. 5.
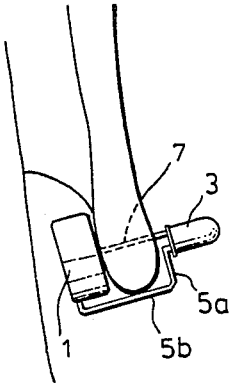
FIG. 1.
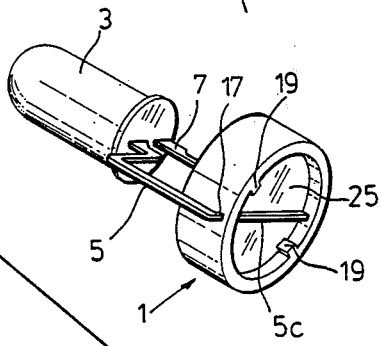
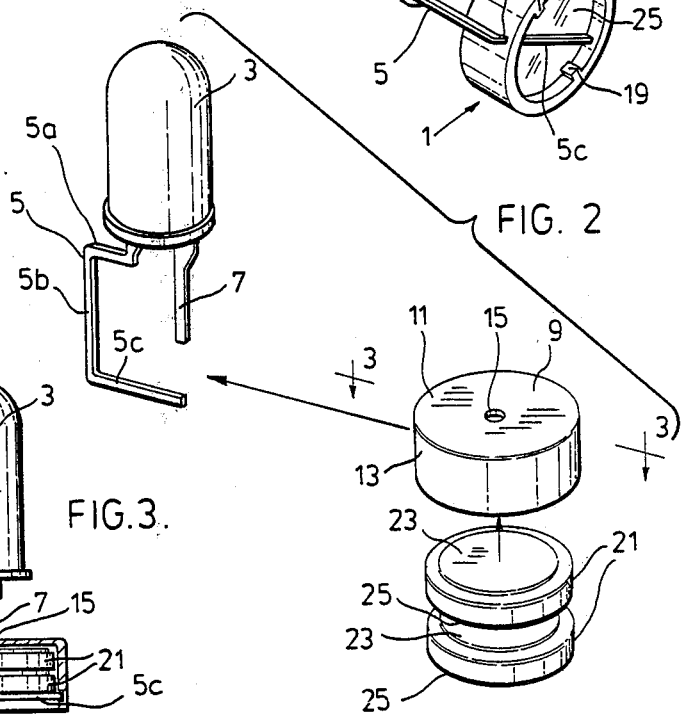
FIG. 2
FIG. 3.
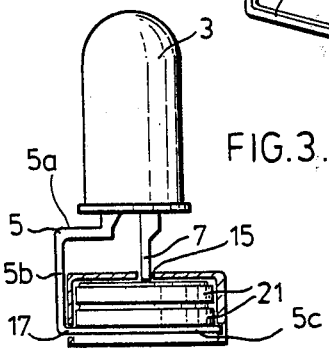

ELECTRONIC EARRING

FIELD OF THE INVENTION

The present invention relates to an electrical earring for use on pierced ears.

BACKGROUND OF THE INVENTION

According to modern day trends, fashion has turned to bright and imaginative wearing apparel which is likely to catch the eye. For example, clothing worn to a fashionable discotheque could well include reflective, sequined blouses or dresses, flashy and sparkling jewellery and even flashing lighted shoes and even lapel buttons, which have only recently become available. There has however, been little development with respect to head garb which is bright and loud enough to compliment these fashionable items. It would appear that there is therefore, a need for a distinctive and imaginative item which can be worn at the facial region to complete these lively outfits.

The present invention provides an electrical earring for use on today's fashionable pierced ears. The earring is formed by an electrical circuit which comprises a portable, electrical power supply at one side of the circuit, load means at the other side of the circuit, a first electrical connector and a second electrical connector. The arrangement is such that the load means may be located to the outside of the ear and the less sightly power supply is substantially hidden behind the ear when the earring is in place. The first electrical connector is adapted to wrap around the earlobe from the load means to one of the terminals at the power supply. The second electrical connector is adapted to project through the pierced earlobe from the load means to the outer terminal at the power supply for the twofold purpose of both closing the electrical circuit and, in co-operation with the power supply, securing the earring in position on the earlobe.

The electrical earring can be made such that it is very noticeable, consistent with some of the other items listed above. For example, the load means of the earring may take the form of a flashing diode which has a particularly noticable effect in a dim or unlit area such as those found in most after hours clubs or discotheques.

BRIEF DESCRIPTION OF THE DRAWINGS

The above, as well as further advantages and features of the present invention will be described in greater detail according to the preferred embodiments of the present invention wherein:

FIG. 1 is a bottom perspective view showing an electrical earring according to a preferred embodiment of the present invention.

FIG. 2 is an exploded view of the earring shown in FIG. 1.

FIG. 3 is a side view of the earring of FIG. 2 showing a section taken along the lines 3—3 of the power supply region of the earring.

FIG. 4 shows an individual wearing the earring of FIGS. 1 through 3.

FIG. 5 is an enlarged rear view of the ear region of the individual of FIG. 4 showing the earring in position.

DETAILED DESCRIPTION OF THE PREFERRED EMBODIMENTS

The preferred arrangement for the earring shown in the drawings comprises a power supply region 1, a diode 3, and a pair of electrical connectors or leads 5 and 7. These components when assembled as shown in FIG. 1 form an electrical circuit with the power supply region at one side of the circuit and the load in the form of the diode at the other side of the circuit.

The power supply region can be seen in more detail in FIG. 2. The actual source of power comprises a pair of identical batteries 21 hooked up in series with one another with each battery comprising a positive terminal 23 and a negative terminal 25. It will be seen from FIG. 2 that the positive terminal 23 of the top battery has an inward exposure relative to the circuit while the negative terminal 25 of the lower battery has an outward exposure relative to the circuit.

Particularly suitable diode for use in the earring is the *Litronix Led Flashing #FLR4403 diode. This diode when used in combination with the *Mallory duracell #10L122 batteries is extremely effective in providing a flashing earring with an on/off flash capable of flashing for extended periods of time, nominally 50 hours.

*Trade Mark

The batteries are held against one another and secured in place by means of a plastic battery holding cap 9. This cap is made from polypropylene or a similar substitute. Cap 9 comprises an endwall 11 against which the positive terminal of the innermost battery is located, a sidewall 13 for wrapping around the outer periphery of batteries 21 and a pair of lugs 19 which secure the batteries in position at the open backside of the cap where the negative terminal 25 of the lower most battery is exposed. The endwall 11 of the cap is provided with a central aperture 15 while the sidewall of the cap is provided with a side opening aperture 17 which is approximately level with lugs 19.

When the earring is worn properly as shown in the drawings, the diode to the outside of the ear and the capped batteries lie substantially behind the ear. Connector 5, which has been specifically adapted to permit this positioning of the earring comprises three sections 5*a*, 5*b*, and 5*c*. These sections are arranged such that section 5*a* extends outwardly away from lead 7, section 5*b* extends downwardly parallel to and beyond lead 7 while section 5*c* extends inwardly back towards and below lead 7. This particular configuration of lead 5 is such that it extends from the diode while wrapping around the earlobe to the power supply as is clearly shown in FIG. 5. The actual electrical contact is made at section 5*c* which extends through aperture 17 of cap 9 along and in contact with the lower or negative terminal 25 of the lower most battery as is clearly shown in FIGS. 1 and 3.

Lead 7 on the otherhand, is adapted to project directly through the pierced earlobe from the diode through opening 15 of cap 9 to the positive terminal 23 of the upper most battery to complete the electrical circuit. In addition, lead 7 in co-operation with the capped batteries forms a clip-like arrangement trapping the earlobe between the batteries and the diode with lead 7 providing a securing member for holding the earring in position on the ear, as is again, clearly shown in FIG. 5.

Not only does the arrangement provide a clip for securing the earring to the ear, but in addition, the batteries are neatly hidden behind the ear making the earring neat and attractive in appearance.

The electrical leads and more particularly, electrical lead 7 is preferably goldplated, so that its outer surface is inert for health purposes to the pierced ear. This in combination with the inert plastic selected for producing the cap, to which the pierced ear is also exposed, make the earring safe against infection to the pierced opening in the ear.

The components of the earring are easily disassembled as shown in FIG. 2 for purposes of both battery replacement and locating the earring in position on the ear. Batteries 21 are easily popped into and out of position in the battery cap over lugs 19, at the rear open side of the cap. Again, the selection of materials i.e., polypropylene and the like, makes the cap resilient enough to snap the batteries into and out of the cap at its backside over lugs 19. The cap is however, at the same time, stiff to the extent that the batteries do not inadvertently, fall out of the open backside of the cap where they are locked in position by lugs 19.

The diode and its electrical leads are removable from the power supply as shown in FIG. 2. This permits the earring to be removed from and placed on the ear. The spacing between section 5*c* of lead 5 and the lower end of lead 7 is set such that there is a clamping action of the leads on the batteries which ensures good electrical contact and at the same time, holds the diode to the power supply. In addition, the penetration of lead 7 through opening 15 prevents wandering of the lead and helps to secure the structure together.

It will be appreciated that other types of electrical loads such as constant lights, glowing watches, etc., can be used on the earring. The particular battery exposure shown in the drawings, is used as diode 3, is polarity sensitive. It will however, be appreciated that if something other than a polarity sensitive diode is used as the load, the battery exposure could easily be reversed where lead 7 extends to the negative terminal and lead 5 extends to the positive terminal of the battery. Furthermore, the leads themselves can easily be reversed on the diode which would permit the batteries to be reversed.

Although various preferred embodiments of the invention have been shown herein in detail, it will be appreciated by one skilled in the art, that variations may be made thereto, without departing from the spirit of the invention or the scope of the appended claims.

I claim:

1. An electronic earring for use on a pierced earlobe, said earring forming an electrical circuit comprising a portable electrical power supply at one side of the circuit, load means at another side of the circuit away from said power supply and first and second electrical leads between and spacing said load means and power supply, said load means, said power supply and said electrical leads cooperating with one another to provide an ear clip arrangement with said power supply forming a first clip portion for clipping immediately behind the earlobe, said load means forming a second clip portion for clipping forwardly of the earlobe, said first lead forming a first connector between said clip portions for projecting through the pierced earlobe and said second lead forming a second connection between said clip portions for wrapping around the earlobe, said power supply and said load means being movable to and from a securing position relative to one another to allow opening and closing of said clip arrangement on the earlobe.

2. An electronic earring as claimed in claim 1, wherein said electrical leads are arranged for clamping on opposing sides of said power supply for closing said circuit and for connecting said load means with said power supply.

3. An electronic earring as claimed in claim 2, wherein said load means comprises a diode.

4. An electronic earring as claimed in claim 1 wherein said portable battery power supply comprises a pair of portable batteries secured in series to one another in a plasticized battery cap, said cap being apertured at said positive and negative terminals to enable electrical contact between said electrical leads and said terminals.

5. An electronic earring as claimed in claim 3, wherein said diode and electrical leads are separable from said power supply to enable clipping of said earring on the earlobe.

6. An electronic earring as claimed in claim 4, wherein said battery cap is provided with retaining means for retaining said portable batteries therein, said cap being adequately flexible to permit removal of the batteries therefrom.

7. An electronic earring as claimed in claim 4 wherein the lead adapted for wrapping around the earlobe comprises a substantially U-shaped member and the lead adapted to project through the pierced earlobe comprises a short, straight stud-like member at essentially 90° to the U-shaped lead.

8. An electronic earring as claimed in claim 7 wherein the lead adapted to project through the earlobe has an inert outer surface.

9. An electronic earring as claimed in claim 8 wherein the lead adapted to project through the earlobe is gold plated.

10. An electronic earring as claimed in claim 7 wherein said batteries have a disc like shape, said cap being in the form of an open ended drum adapted to snugly receive said batteries said comprising an endwall and a substantially circular sidewall, said endwall being provided with a generally centrally located aperture for enabling contact between the lead adapted to project through the earlobe and one of the terminals of the battery power supply said sidewall being provided, retaining means spaced from said endwall for retaining the batteries therein and an opening approximately level with said retaining means to enable contact between the lead adapted to wrap around the earlobe and the other of the terminals of the battery power supply, said leads being slidable into a contact position with said batteries as a sole means for connecting said load means with said power supply.

11. An electronic earring as claimed in claim 3, wherein said diode is adapted to flash.

12. An electronic earring as claimed in claim 7, wherein said cap is open at both ends and wherein said leads are adapted to slide into contact with said power supply to clamp onto said batteries at said both ends of said cap for securing said load means to said power supply.

* * * * *